US005095561A

United States Patent [19]

Green et al.

[11] Patent Number: 5,095,561

[45] Date of Patent: Mar. 17, 1992

[54] INVALID BED

[76] Inventors: Kenneth J. Green, 7500 N.W. 52nd St., Miami, Fla. 33166; Ulises A. Silva, 1425 N.W. 10th Ave., Suite 302, Miami, Fla. 33136

[21] Appl. No.: 697,687

[22] Filed: May 9, 1991

[51] Int. Cl.[5] ..... A61G 7/15; A61G 7/5; A61G 7/53

[52] U.S. Cl. ..... 5/618; 297/DIG. 10; 5/616; 5/81.1

[58] Field of Search ..... 5/60, 62, 63, 64, 66–69, 5/81 R; 297/DIG. 10

[56] References Cited

U.S. PATENT DOCUMENTS

| | | | |
|---|---|---|---|
| 1,122,251 | 12/1914 | Campbell | 5/62 |
| 3,112,500 | 12/1963 | MacDonald | 5/68 |
| 3,239,853 | 3/1966 | MacDonald | 5/68 |
| 4,007,960 | 2/1977 | Gaffney | 297/DIG. 10 |
| 4,376,317 | 3/1983 | Johnston | 5/68 |
| 4,453,766 | 6/1984 | DiVito | 297/DIG. 10 |
| 4,979,726 | 12/1990 | Geraci | 297/DIG. 10 |
| 5,024,486 | 6/1991 | Avel | 297/DIG. 10 |

*Primary Examiner*—Alexander Grosz
*Attorney, Agent, or Firm*—Malloy, Downey & Malloy

[57] ABSTRACT

A conventional adjustable hospital bed of the type on which a person can selectively change his position by pivotally raising a back panel and/or raising pivotally interconnected leg panels. Additionally, the bed includes a rotatable carriage beneath the mattress to rotate the mattress, out of parallel coalignment with the bed, while the person is supported on the mattress, to a position at about 90° thereto, the occupant can then be lifted to a standing position with the aid of a tiltable panel to, in effect, provide assistance in getting out of the bed. The mattress is supported on a rotatable carriage assembly at one end of which is the back support panel and at the other end of which are the leg support panels with the ejector panel being centrally located between the back and leg panels. The panels are moved by energizing motors, selectively by the patient.

4 Claims, 3 Drawing Sheets

INVALID BEDcl FIELD OF THE INVENTION

This invention relates to beds of the type often referred to as hospital beds.

SUMMARY OF THE INVENTION

A conventional adjustable bed including means patient in a bed to achieve a standing position. The bed includes pivotal panels on a carriage assembly rotatable with respect to the bed frame. In use, the panels and carriage assembly support the mattress as it is rotated through at least 90° with respect to the alignment of the main bed frame, allowing the patient to egress the bed to a standing position at the side of the bed.

BACKGROUND OF THE INVENTION

There exists in the prior art many forms of beds designed to give support and comfort to the user. These beds range from anything having a raised head portion to beds that rotate to bring about a certain position. A problem exists with the prior art because some weakened patients, while being somewhat ambulatory, cannot get out of bed without the help of another. It is important that such patients do get out of bed from time to time for exercise and to attend to their personal needs. Because of a shortage of help, their fundamental needs are not met in too many cases. On the prior art, there are beds that will elevate the head and back and some that will elevate or lower the legs. Other patents disclose beds that rotate at or around 90° to change the direction of ingress or egress. The main problem remains, however, that patients (primarily in nursing homes) who are confined to beds, still need to leave their beds for exercising, fresh air, change of clothes, etc. But, because so much time and effort has to be expended by the medical staff on getting each patient into an upright position from a usually horizontally supported position, the patients' needs are often not met. This invention alleviates those problems mentioned above in a most efficient and economical way. The patient himself, or a member of the medical staff, simply has to push a button to activate an electrical motor governing the rotation and pivoting of the bed. Generally, the patient himself or a member of the medical staff will first energize the motors to raise the patient's back and head and legs and then will energize the motors to rotate the upper supported mattress above the main bed out of alignment with the main bed, at about 90° thereto, whereupon an ejector panel connected between the back panel and leg panels is activated to raise the person to a standing position. While beds are known in the prior art which have mechanisms whereby the back panel and leg panels and the mattress support rotated, achieving a seated position for an occupant, none provide an ejector panel to raise the patient from the seated attitude to a standing position. Some of the patents of the related field are described below together with the problems associated with them, and the differences between them and the applicant's claimed invention.

U.S. Pat. No. 3,112,500—MacDonald

MacDonald discloses a hospital bed which can be adjusted to a raised position in a longitudinal position and can then be rotated through 90° to either side of the longitudinal position to form a chair for the patient. Pivoting is achieved with carriage assembly 41. After pivoting, the patient's feet rest on a foot rest.

U.S. Pat. No. 3,239,853—MacDonald

This patent discloses a hospital bed in which the mattress frame can be rotated 90° and may assume the position of a chair. The patient may then be gently and easily placed in a normal full sitting position without necessitating his removal from the bed. The frame may be rotated by an electric motor.

U.S. Pat. No. 4,376,317—Johnson

Johnson discloses an adjustable bed for the care of obese patients which includes a ground engaging frame to assist the patient to get on and off the bed. It employs a foldable step arrangement connected to a foot section. As shown in FIG. 1, the patient's feet are supported on foot plates 83, which may be pivoted out of the way around pins 86. The patient exits the bed by stepping down onto step 8.

U.S. Pat. No. 1,122,251—Campbell

Campbell discloses an improved bed with a mounting so that the bed may be rotated in order to permit the floor beneath the bed to be easily swept. Also the bed may be tilted. This bed can therefore be moved across a room from one place to another.

DESCRIPTION OF THE PREFERRED EMBODIMENT

Figure 1:
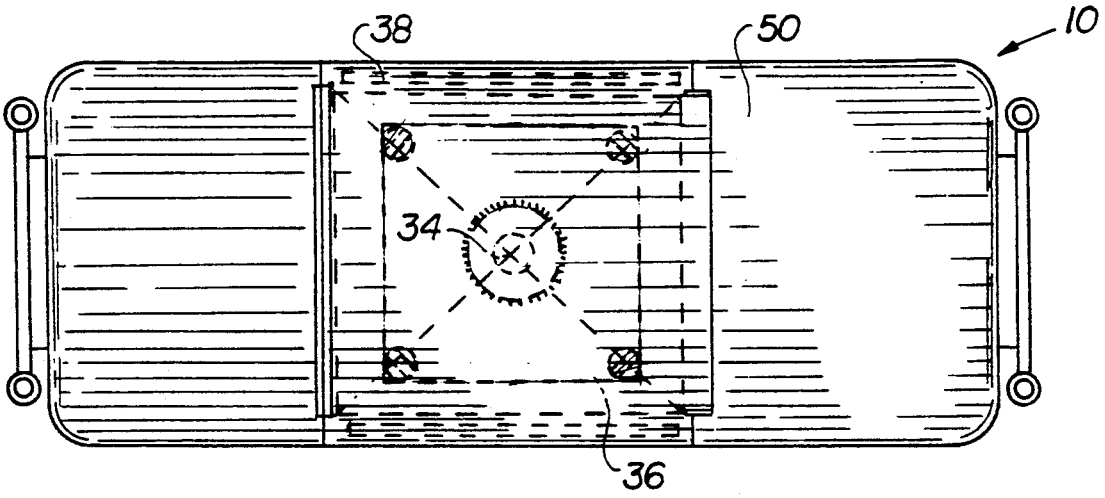
FIG. 1 is a plan view of a hospital bed in accordance with this invention.
Figure 3:
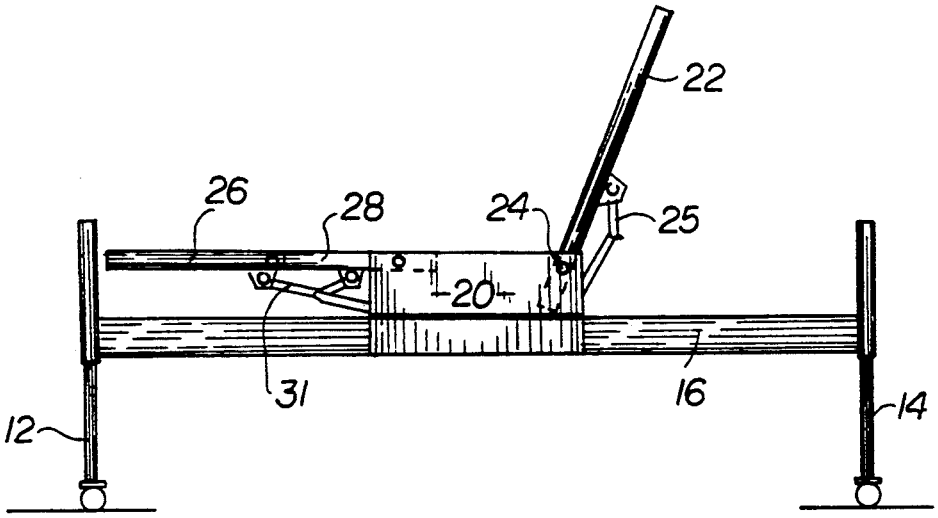
FIG. 3 is a side elevation view illustrating the back support panel of the bed in an elevated position.
Figure 4:
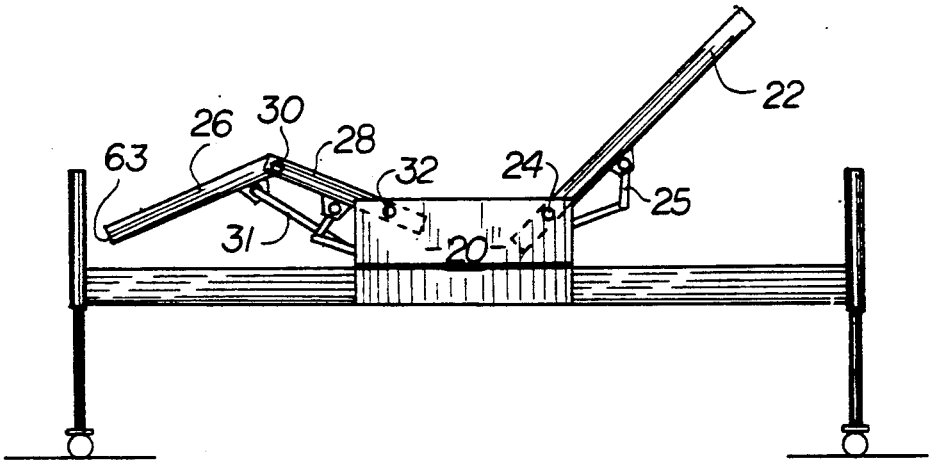
FIG. 4 is a view similar to FIG. 3 and illustrating the hingedly connected pair of leg support members at an angle.

Referring to FIG. 1, there is shown a hospital bed generally deigned by the numeral 10 which it is seen on reference to FIG. 3, for example, includes a forward and rearward pair of support legs 12 and 14 spanned by a frame 16. On the frame 16, there is a carriage assembly generally designated by the numeral 20. This is centrally arranged on the frame and includes a back panel 22 pivotally connected to it as at 24 for swinging movement between a generally horizontal plane and an elevated position. Link means 25 support the panel in its various attitudes. There are also a pair of pivotally interconnected leg support portions 26 and 28, the same being pivotally connected as at 30; and this pair of leg support portions is pivotally connected, as at 32, to the carriage assembly 20. Again, link means 31 support these panels. Suitable mechanisms as are conventional are employed to selectively raise and lower the back support panel and the pivotally interconnected pair of leg support panels.

Figure 2:
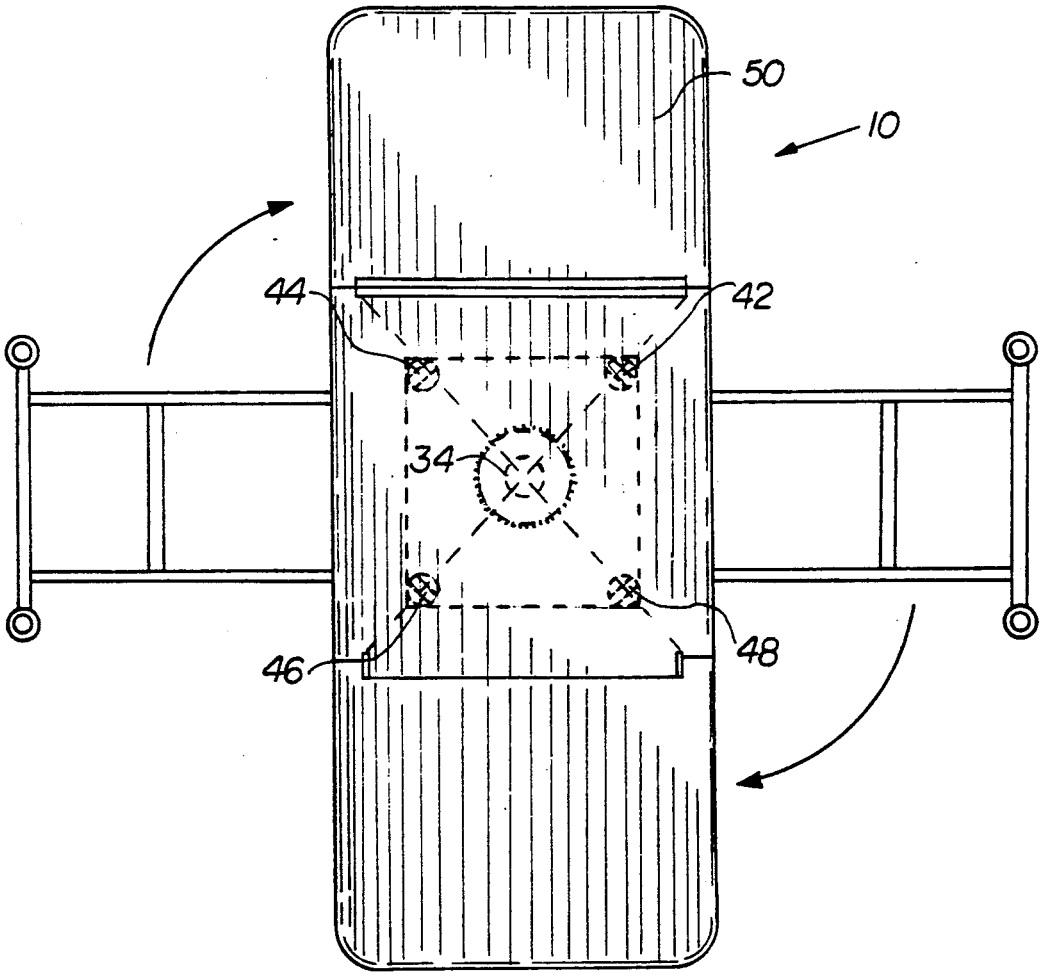
FIG. 2 is a view similar to FIG. 1 with the mattress moved through 90° of rotation.

Referring back to FIG. 1, the carriage assembly 20 includes a central spindle 34 which has a lower end journaled to a support plate 36 and an upper end keyed to a rotatable member 38. It is thus seen that when the spindle is rotated, the mattress supported upon the carriage assembly and panels is also rotated. It can be rotated through at least 90°, as shown in FIG. 2. Preferably, caster-type supports are provided to lend smoothness of operation such as those indicated by the numerals 42, 44, 46 and 48. In a preferred embodiment, a motor means is provided to drive a gear connected to the spindle for rotation of the carriage assembly, panels and mattress.

Figure 5:
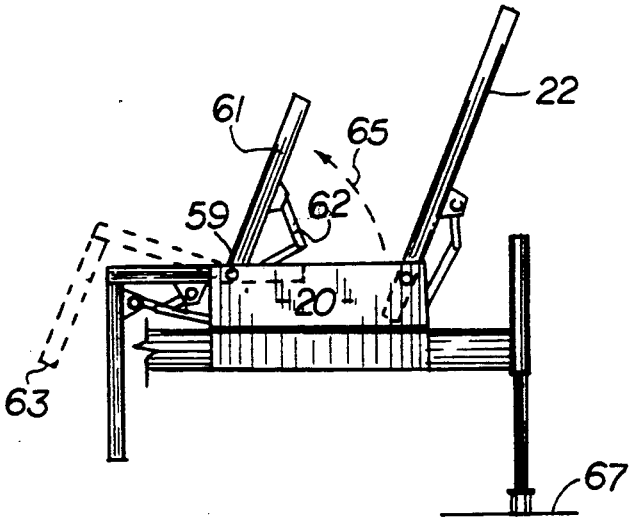
FIG. 5 is a partial end view illustrating the operation of the device for ejecting a person from a seated position and into a standing position.
Figure 6:
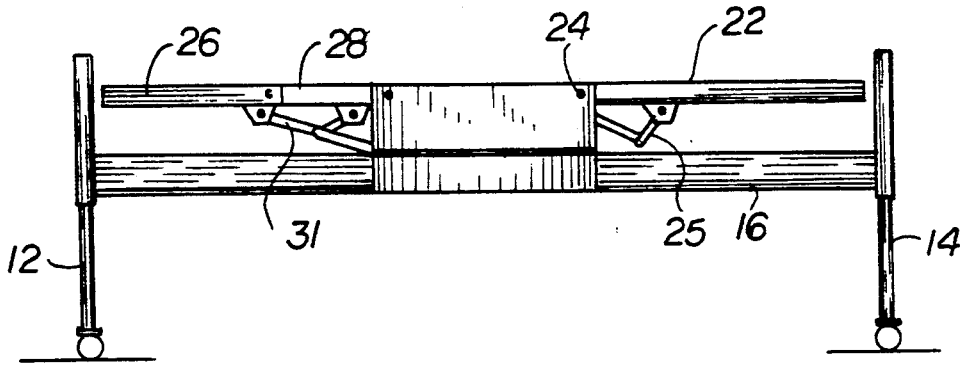
FIG. 6 is a view illustrating the legs of the bed telescopically arranged and in an extended position.
Figure 7:
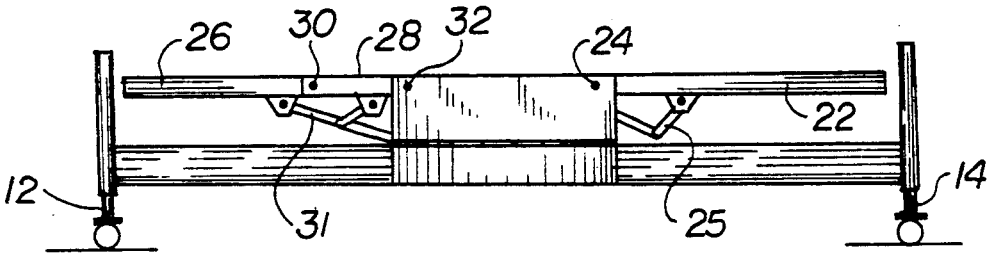
FIG. 7 is a view similar to FIG. 6 with the bed in a lowered position.

Between the back panel and the leg panels, there is an ejector or lift panel 61 pivotally mounted as at 59 to the carriage assembly 20 as seen in FIG. 5. Link means 62 are provided to support the panel in its various positions.

It is conventional to provide a hospital bed with an assembly which includes motors to lift the back panel and leg panels. This invention provides, additionally, the means for rotating the bed to 90° and the ejector or lift panel 61. In use, a mattress 50 positioned on the bed is supported by the leg panels and the back panel as well as the ejector panel which are normally in co-planar generally horizontal position. To aid an occupant in the bed to move to a standing position, the mattress is rotated through at least 90° being supported by the panels on the carriage assembly. When in the position shown in either FIG. 1 or FIG. 2, the back panel is raised as are the pair of leg panels so that the occupant is in essentially a seated position on the mattress. In this position, the terminal end of the outermost leg panel is closely adjacent the floor. The height of the mattress above the floor is adjustable by reason of the leg panels, which support the bed, being telescopically interconnected portions which can be extended or withdrawn to accommodate. The feet of a person in a properly adjusted bed, height-wise, are practically on the floor, when in the seated position. It being noted that this is effected by swinging the pair of legs until the outer terminal end 63 is at about the floor or support surface 67, that is, the outer leg support panel is substantially vertically aligned. The occupant will be in a substantially seated position at this time whereupon the ejector panel 61 is pivotally moved in the direction of the arrowed line 65 to gradually raise the occupant into a standing position. A tether not shown is provided to keep the mattress on the panels.

Figure 8:
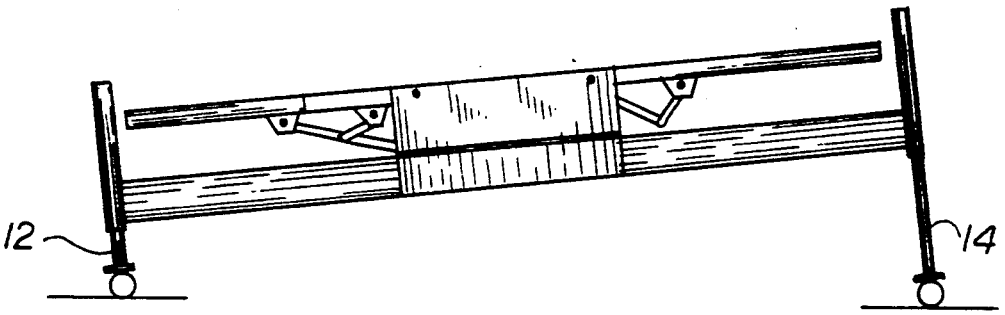
FIGS. 8 and 9 are side elevation views illustrating optional arrangements for the attitude of the bed in use.
Figure 9:
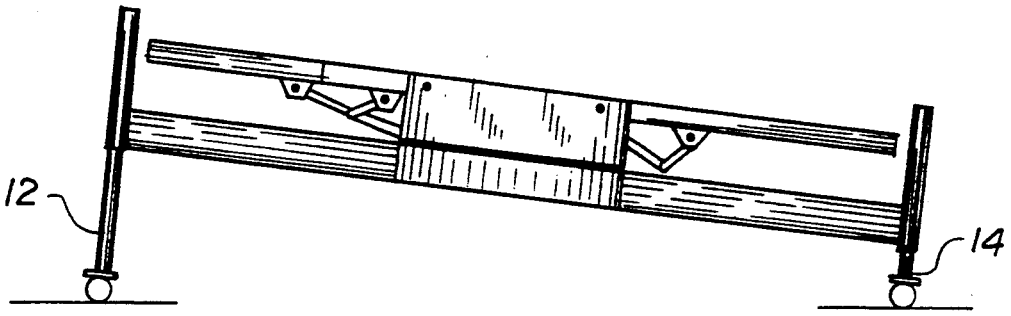

It will be seen on reference to FIGS. 8 and 9, for example, that different attitudes may be arranged for the bed by raising or lowering the support legs, 12 and 14. In a preferred embodiment, there will be limit switches to limit the range of rotation of the mattress and, preferably, there will be a sensor so that if there is undue resistance encountered upon rotation, the rotation of the mattress will cease. The construction and motorized elements which are conventional in what are known as hospital beds, have not been shown to simplify this description. The control for the bed is conventional and will include a drive means for the rotation of the mattress on the panels, spindle and carriage assembly. Additionally, a lock means so that this rotation of the mattress can only occur under the supervision of a doctor or nurse may be provided.

It is thus seen that there has been provided an electromotive hospital bed specifically for patients who, while being somewhat ambulatory, have problems getting out of a bed. The bed of the present invention is anthropometrically designed to facilitate and enable the occupant to do that in a biomechanically efficient fashion. In operation, the structure disclosed ergonomically mimics the normal positions that a patient would progressively assume in order to get out of a bed and stand up along side of it. In general, a carriage assembly that rotates supports a multi-positional bed frame composed of pivotal panels whereby the panels can be rotated through about 90° and then configured into a chair-like support structure. At this juncture, when the feet of the user are closely adjacent the floor, the center frame or rejection panel moves upward in the sagittal plane pushing the buttocks of the user upwardly and forwardly and gently urging the person out of the seated position and into a standing position.

While this invention has been shown and described in what is considered to be a practical and preferred embodiment, it is recognized that departures can be made within the spirit and scope of this invention which should therefore not be limited except as set forth in the claims which follow and in accordance with the Doctrine of Equivalents.

What is claimed is:

1. A bed having a head end and a foot end comprising:

A. a normally horizontal bed frame and a support means beneath the frame, said frame having a central longitudinal centerline of symmetry between two spaced generally parallel longitudinally extending sides, B. an upstanding mattress support structure on the frame, said support structure including:

a) a central portion with a head end zone and a foot end zone, b) a back panel portion extending toward the head end from the central portion, c) a distal leg panel with a distal zone having a terminal edge and a proximal leg panel having a distal and a proximal edge and a proximal zone, means pivotally interconnecting said leg panels and said leg panels extending toward the foot end from the central portion, and d) a lift panel at the central portion having a head end and a foot end, said lift panel adapted to swing from a horizontal plane to lift a patient from a supported position to a generally standing attitude, C. said mattress support structure including pivot means interconnecting the a) foot end zone of the central portion to the proximal zone of the leg panels, b) the head end zone of the central panel to the back panel, and c) the central portion to the lift panel, d) said panels being normally in a co-planar generally horizontal relation to one another to support a mattress, e) each panel having a centerline normally aligned in co-planar relationship with the centerline of the mattress frame, f) means on the mattress support structure to support the panels, D. means journaling the mattress support structure on the frame for rotating the mattress support structure through an angle of about 90° so that the centerlines of the panels are in a common vertical plane generally perpendicular to the frame centerline, and E. drive means to pivotally and selectively lift the panels from the normal co-planar relationship and to rotate the mattress support structure.

2. A bed as set forth in claim 1, including lets comprising telescoping portions to raise the bed height and lower it.

3. A bed as set forth in claim 1 wherein the means for journaling the mattress support structure on the frame includes a plurality of rollers radially spaced from the axis of rotation.

4. A bed as set forth in claim 1 wherein link means are provided interconnecting the panels and the frame to support the panels.

* * * * *